United States Patent [19]

Kiyomura et al.

[11] 4,418,104

[45] Nov. 29, 1983

[54] FUR-LIKE NAPPED FABRIC AND PROCESS FOR MANUFACTURING SAME

[75] Inventors: Yoshiteru Kiyomura, Shiga; Yutaka Masuda, Otsu; Tatsuji Kojima, Uji, all of Japan

[73] Assignee: Toray Industries, Inc., Tokyo, Japan

[21] Appl. No.: 382,569

[22] Filed: May 27, 1982

Related U.S. Application Data

[63] Continuation of Ser. No. 199,545, Oct. 22, 1980, abandoned.

[30] Foreign Application Priority Data

Oct. 25, 1979 [JP] Japan ..... 54-138146

[51] Int. Cl.[3] ..... B32B 5/06; B32B 7/08; D04H 11/00

[52] U.S. Cl. ..... 428/15; 26/2 R; 26/29 R; 28/107; 28/109; 428/16; 428/89; 428/91; 428/92; 428/234; 428/235; 428/300; 428/301

[58] Field of Search ..... 428/89, 91, 92, 15, 428/16, 234, 235, 300, 301; 26/2 R, 29 R; 28/107, 109

[56] References Cited

U.S. PATENT DOCUMENTS

| | | | |
|---|---|---|---|
| 2,115,581 | 4/1938 | Johnson | 428/91 |
| 2,737,702 | 3/1956 | Schmidt | 428/89 |
| 3,674,618 | 7/1972 | Spann | 428/91 |

*Primary Examiner*—Marion McCamish
*Attorney, Agent, or Firm*—Austin R. Miller

[57] ABSTRACT

A fur-like napped fabric and process for manufacturing same are disclosed wherein a fiber layer comprising uncrimped short fibers or short fibers having a number of crimps of not greater than 10 crimps per inch are provided as a fiber layer on a base fabric. The fibers are then implanted into the base fabric by needle punching. Thereafter, the fibers are raised to form a nap. After needle punching, the base fabric and fibers may be bonded to each other by means of a backing treatment or the like which is carefully applied so as not to permeate the raised hair portion extending on the front surface of the fabric. Especially pleasing aesthetic effects are produced when the napped fibers have static frictional coefficients of less than 0.35 and wherein the bending recovery rate of said fibers is higher than 50%.

9 Claims, 4 Drawing Figures

FUR-LIKE NAPPED FABRIC AND PROCESS FOR MANUFACTURING SAME

This is a continuation of application Ser. No. 199,545 filed Oct. 22, 1980, now abandoned.

BACKGROUND OF THE INVENTION

1. Field of the Invention

The present invention generally relates to a fur-like napped fabric and to a process of manufacturing same. More particularly, the present invention relates to a fur-like napped fabric having raised hair-like fibers. The fabric resembles natural animal furs such as furs of minks, foxes, etc.

2. Discussion of the Prior Art

To obtain napped, i.e. hair-raised, fabrics similar to natural furs, conventional processes such as weaving or knitting of pile fabrics, sliver knitting, tufting and the like, have been employed. Although various improvements have been proposed with respect to raw fibers and finishing methods based on the above described processes, these known methods have common disadvantages as noted in the following points which have been studied in investigations carried out by the present inventors:

(1) Since the nap, i.e. raised hair, is composed of yarns (bundle of fibers) of approximately the same length which are regularly disposed along the flat surface of the base cloth or foundation, the bundles become visible when the fabric is bent or folded. Further, the napped pile is likely to become uneven.

(2) in the case of cut pile fabrics, the lengths of the nap or raised hair are too regular, with the ends of the hair not being sharpened. Thus, these fabrics are readily distinguished, at a glance, as being imitation.

(3) When the fibers which are later formed into nap are made from sliver or yarn, crimp has normally been imparted thereto. However, for napped fibers, especially of the long hair (guard hair) component type, it is desirable to provide straight non-crimped bristles to enhance the hand and appearance of the fabric. Therefore, when nap is formed from sliver or yarns, processes for removing crimp by a polisher, etc. are employed, but these processes have not been totally effective in their attempts to completely remove the crimp.

In view of the above points, even when tapered fibers such as those disclosed in U.S. Pat. No. 3,930,106 are adopted in the form of a sliver knit, etc., the disadvantages described in the items (1) and (3) above cannot be eliminated. Meanwhile, in those cases where sharpened fibers are subjected to electric implantation the above drawbacks are improved, with fur-like fabrics of comparatively good quality being provided. However, this process has provided some problems in that it is very difficult to implant long fibers at high density.

SUMMARY OF THE INVENTION

The above and other drawbacks of the prior art have been surprisingly eliminated or minimized by the present invention.

More specifically, the present invention relates to a fur-like napped fabric mainly covered with raised hair, and characterized in that (a) the ends of the nap, i.e. raised hair, on the surface are sharpened, (b) the raised hair extends into the base fabric and (c) portions between points of implantation are not interconnected by fibers of the raised hair. The invention also pertains to a process for manufacturing the above described fur-like napped fabric comprising the steps of forming, on a base cloth, a fiber layer composed of short fibers without crimp or those having crimp less than 10 curls/inch, implanting said short fibers into the base cloth by needle punching, and subsequently causing said short fibers to be raised or erected. Hereinbelow, the present invention will be described in detail with reference being made to the appended drawings.

DRAWINGS

In the drawings, FIG. 1 is a schematic view of a preferred embodiment of the present invention;

DETAILED DESCRIPTION

Figure 1:
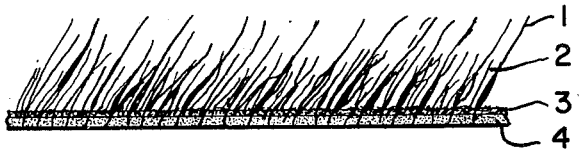

Reference is made to FIG. 1, which schematically shows a fur-like napped fabric according to one preferred embodiment of the present invention. In FIG. 1, the numeral 1 shows the guard hair, numeral 2 the down hair, numeral 3 a base cloth, and numeral 4 a resin layer. In this embodiment, the raised hair is sharpened both in the guard hair 1 and down hair 2 and extends through the base cloth 3 as shown. Moreover, the raised hair, i.e. napped fibers, are characterized in that they are not interconnected among the points of implantation. Furthermore, there is no regularity in the arrangement of the points of implantation, while the raised hair (having no crimp) is highly parallel without intertwining therebetween, and has a proper length distribution.

Figure 3:
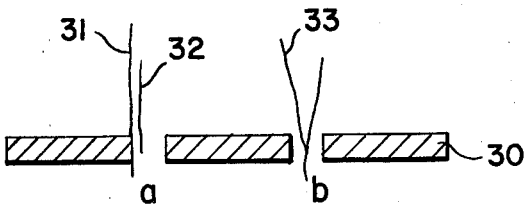
FIG. 3 is a magnified schematic side view of a fabric in accordance with the invention.

Referring now to FIG. 3, the points of implantation are designated as a and b. In the nap or raised hair denoted by 31, 32 and 33 respectively, the air 31 extends into the reverse surface, and the hair 32 stays, at its one end, within the base cloth, while the hair 33 is implanted in the form of V at the same point of implantation. Meanwhile, the fur-like fabric of the present invention is characterized in that the respective points of implantation are not interconnected by the nap or raised hair fibers.

Figure 2:
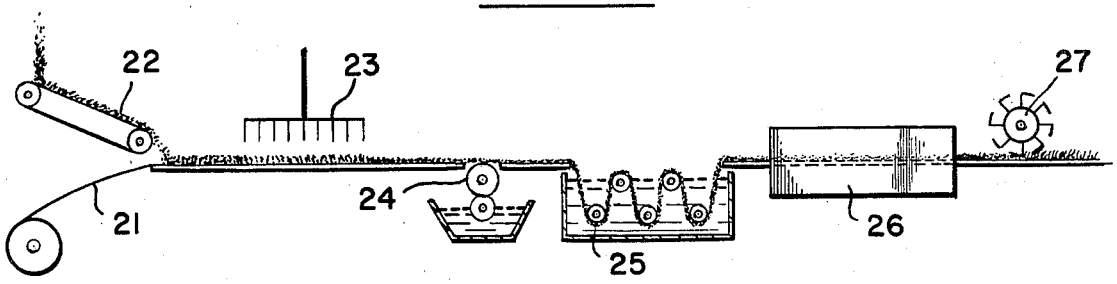
FIG. 2 is a schematic flow diagram, showing a process for producing a fur-like napped fabric in accordance with the invention.

Referring now to FIG. 2, this shows a flow-sheet of a process for manufacturing the fur-like napped fabric according to the present invention. Here base cloth 21, fiber layer 22 for the nap or raised hair component, a needle 23, a roller 24 for backing resin, a wet-type coagulation bath 25 (which may be unnecessary depending on the kinds of resins), a dryer 26 and a raising machine 27, are provided. It is to be noted here that, although the respective processes are shown as being continuous in the figure, these processes may of course be effected independently. It should also be noted that the present invention, is particularly characterized in that one or a plurality of the naps or raised hair fibers extend into the base fabric so as to be implanted at that location. Also the points of implantation are not interconnected by the raised hair fibers. By the above arrangement, a high density nap or raised hair construction of comparatively thick fibers is readily obtained on a thin base cloth, without spoiling the flexibility of the base cloth. The above structure according to the present invention is markedly different from that of ordinary woven or knitted pile fabrics in which the nap or raised hair fibers are erected at 2 points of implantation through the base cloth structure, and wherein part of the raised hair fibers are integral with the base cloth structure. Furthermore, the fur-like napped fabric of the present invention has further advantages since the nap or raised hair fibers have been extended into the base cloth. These advantages may be summarized as follows:

1. The bonding ability can be improved by imparting resin.

2. The parallelism of the raised hair may be improved by causing the nap or raised hair fibers to extend into the base cloth in one predetermined direction. The fact that the nap or raised hair fibers are implanted by extending into the base cloth means that part of the raised hair fibers are held inside the fabric base, and includes the case where central portions of the nap or raised hair fibers are implanted within the base in the form of a V at one implantation spot, and the case where one end of the raised hair fiber is held within the base or extends out of the reverse surface of the base.

Preferable structures according to the present invention are summarized as follows:

(a) There is no regularity in the disposition of the points of implantation, (b) the nap, i.e. raised hair, has a favorable length distribution and (c) the nap has substantially no crimp at the raised hair end portions (sharpened portion), and (d) the high degree of parallelism of the nap or raised hair substantially eliminates any intertwining, etc.

The absence of regularity in the arrangement of points of implantation means that there is no repetitive nature as in woven or knitted pile fabrics. However, it is not necessary that the points of implantation be chosen totally at random. The advantage of the last of regularity in the arrangement of implantation points is that the base cloth is not readily observed even when the napped fabric is bent or folded. Further the raised hair or nap does not appear to be in the form of bundles or stripes.

The fact that the ends of the nap or raised hair are substantially without crimp and in the form of points, with favorable length distribution, further improves unravelling of the nap or raised hair, and ensures that a fur-like appearance and hand are obtained. In connection with the above, the presence of a favorable length distribution means that individual naps or raised hairs have no fixed or constant length, although, when observed at a distance the naps appear to have uniform length like a fur-like fabric.

Meanwhile, the tip portions of the raised hair are sharpened or tapered, and more preferably, observed to be in the form of a point, and particularly preferably, such tip portions should have a diameter less than 10 $\mu$. With respect to the sharpened configuration, such shape as will become gradually thick from the tip without curling or bending is preferable, while the lengths of the sharpened portions should preferably be in the range of 2~15 mm for visual effect.

As is readily understood, possession of sharpened tips substantially in the form of points imparts a smooth and soft touch to the fabric, similar to natural furs. However, what is more interesting is that it gives a deep, plushy appearance, due to the fact that the tips of the raised hair exhibit only a minimal sight-obstructing effect. This is even more apparent when the lengths of the nap or raised hair have an irregular distribution. More specifically, when the volume occupied by the napped or raised hair fibers with respect to the thickness of the napped fabric becomes low (density/thickness ratio), the sight-obstructing quality of the nap decreases, thus making it possible to observe the inner portion of the napped fabric. It should be particularly noted that the present inventors have ensured for the first time that this effect is similar to high class natural furs.

Although the raised hair is not to be particularly restricted in its length distribution and size, it is preferable that the value of $(L-l)/A$ is larger than 0.3, where L is the maximum length in mm, l is the minimum length in mm, and A is the average length in mm in the case where approximately 10 pieces of raised hair are taken as a random sample.

The fact that the nap, i.e. raised hair, is highly parallel, with substantially no intertwining therebetween may be indicated, for example, by the fact that the resistance is small when the napped or raised hair fabric is "combed." Such structure can be obtained when the raised hair is straight, with substantially no crimp or when only a very small crimp is present. Furthermore, it has suprisingly been found that, if the raised hair is comprised of fibers having a static frictional coefficient of less than 0.35, and more preferably less than 0.3, an animal fur-like slipperiness, suppleness, and repellency can be obtained due to the synergistic combination of the aforesaid fiber property and the novel fabric construction of the present invention. In connection with the above, the static frictional coefficient is represented by the value measured according to the so-called Röder method based on JIS-L-1074.

In the present invention, although the size of the synthetic fibers having the sharpened ends, average nap length and nap density, etc. are not particularly limited, the preferable range should be 2~100 denier for the size, 5~80 mm for the average nap length and 50~20,000 pieces/cm$^2$ for the nap density. Similarly, there is no particular limitation in the cross-sectional configurations of the synthetic fibers which may be used, and cross sections of round and elliptic shapes or of multifoliate shape can be employed. Moreover, fibers having thick and thin portions in their lengthwise direction may also be employed. Meanwhile, the points of implantation should preferably be more than 50 spots/cm$^2$, and more preferably, more than 100 spots/cm$^2$.

According to the present invention, a fabric of favorable quality is available in single layer construction, but in many cases, it is possible to produce a fabric with a two layer construction equivalent to the guard hair and down hair of natural furs. It is also possible to produce a fabric having more layers. In the later cases, at least the guard hair portion has to be composed of the fabric according to the present invention, without any limitation on the down hair fabric portion.

For the fiber materials constituting the nap, i.e. raised hair, those having good bending recovery characteristics, especially fibers having bending recovery rates of more than 50% are preferable. The bending recovery rate as described above may be defined as follows.

With one piece of fiber folded, a load of 300 g is applied to a depressing face of 5 cm×5 cm, and the sample is left as it is for 30 seconds.

The following angle $\theta°$ is measured 10 minutes after removal of the load to work out the bending recovery rate by the following formula.

$$\text{Recovery rate (\%)} = \frac{\theta^\circ}{180^\circ} \times 100$$

Although fibers of polyamide series, polyester series, etc. may be quoted as those satisfying the above requirements, the characteristics may be altered by heat treatment even amongst the same fibers, and fibers subjected to slackening or constant length heat treatment show higher bending recovery characteristics.

Especially preferable are those fibers of polybutylene terephthalate series and polyamide series.

Regarding the fabric to be employed as the base, there are no particular limitations, either, and woven and knitted fabrics and non-woven fabrics may be employed. Although there are no restrictions in raw materials and textures, fabrics soft and dense, and comparatively thin in thickness are preferable.

In the process according to the present invention, it is desirable to employ sharpened fibers which have been sharpened at both ends thereof. In the case where more than 2 kinds of fibers are used, it is advisable to employ sharpened fibers for the guard hair component constituting at least the surface of the napped fabric.

With respect to the process for obtaining the sharpened fibers, several proposals have already been made, any of which may be adopted, but the resultant fibers should preferably be sharpened at both ends. The recommended method for simultaneously sharpening both ends is disclosed in Japanese Laid Open Patent Application Tokkaisho No. 54-38922 (of common inventorship herewith). These fibers (both ends sharpened) are used independently, or by mixing of more than two kinds, or by mixing with other fibers, to become the down hair so as to form a layer on the base cloth by suitable methods.

In the above case, it is preferable that the fibers have substantially no crimp or less than 10 crimps/inch (even in this case the crimp should preferably be shallow, small and closer to a straight line), and the fiber layer should, more preferably, have less intertwining than normal. If a fiber layer with high crimp and strong intertwining is formed, the intertwining degree is further increased by the needle punching, thus not only making it difficult to effect raising, but also degrading the nap quality.

In accordance with the invention, suitable fiber layers are obtained by a process in which the fibers are separated in a fluid such as air, water or the like, and are then accumulated on the base cloth without disturbance.

The base cloth for the base of the napped fabric is not particularly limited in raw materials, construction textures, etc., and woven or knitted fabrics, non-woven fabrics, etc. and comparatively thin, and soft and delicate structures may be employed.

In the needle punching process, the needle structure is not specifically limited. However, barbed needles are preferably employed. It is sufficient if at least one of the barbed portions is adapted to extend through the base cloth, and there are no limitations with respect to the configurations of the needle, number of the barbs, degree of needle depth, number of punchings, etc. Subsequently, by raising the surface with the use of a raising wire cloth or the like (after the reverse surface has been backed with a suitable resin to impart a certain degree of adhesiveness), the fibers not subjected to implantation are removed, while the intertwining is eliminated from the implanted fibers for arranging the nap, i.e. raised hair, in order.

In the above case, it is desirable to raise the fibers without being cut, by controlling the adhesive, raising method and raising conditions, etc. The napped fabric thus obtained fundamentally satisfies the structural requirements of the present invention, and provides a fur-like fabric superior in appearance, and feeling or hand.

Furthermore, it is possible to adopt various other processes to more fully display the effects of the present invention. For example, physical operations such as brushing, combing, polishing and the like, physical or chemical treatment in a bath (this is effective for recovery of nap linearity, removal of excessive nap, softening of hand, etc., if the conditions are suitably set), and chemical treatment such as the application of various chemical agents, etc. for fabric surface, and also shearing, secondary backing, singeing, buffing, flocking, laminating and the like for the reverse surface may be employed.

In the present invention, although the means for reducing the static frictional coefficient of the fibers constituting the raised hair or nap to less than 0.35 is not particularly limited, this is achieved in the raw fibers by imparting various organic or inorganic additives thereto (for example, titanium oxide, kaolin, talc, silicone series compounds, etc.), finishing agents such as various durable softening agents, lubricating agents (those of silicone series, urethane series, etc.), or combinations of these.

As is seen from the foregoing description, the napped fabric according to the present invention is a fur-like fabric which is superior to the conventional fur-like fabrics in appearance, and hand. Furthermore, as compared with natural furs, the napped fabric of this invention has various other advantages such as excellent resistance against moths, water and light, and has favorable washability The following EXAMPLES are inserted for the purpose of illustrating the present invention, without any intention of limiting the scope thereof. In the first place, it is to be noted here that in the following EXAMPLES, the fibers with both ends sharpened have been produced by the method described in Japanese Laid Open Patent Application Tokkaisho No. 54-38922. This method comprises collecting polybutylene terephthalate fibers in bundle form, with the side faces thereof covered with paper. The bundles thus prepared are cut into a predetermined length and are totally immersed in an aqueous solution of caustic soda of 40 weight % at temperatures of 100°–120° C. and are treated for 60–90 minutes. After this treatment, the covering paper is removed, and the fibers are sufficiently washed and dried. By the process as described above, sharpened fibers (both ends being sharpened) of polybutylene terephthalate having various cross sections and any desired thickness and length, can be manufactured. The polybutylene terephthalate fibers thus obtained will have a bending recovery rate of 70–85%, with the taper process imparting a heat treating effect. In the EXAMPLES that follow, the thicknesses (in denier) of the fibers are represented by the values measured prior to the taper processing for convenience.

EXAMPLE 1

The raw fibers having the construction as shown in Table 1 were mixed by the use of air, and subsequently, caused to form a fiber layer at the rate of 1300 g/m$^2$ on a polyester 65/cotton 35 plain fabric of 100 g/m$^2$ weight, By using a 9 barb needle (manufactured by Organ Needle Co., Ltd., model FPD-1 #36) as the felting needle, needle punching was effected under conditions of needle depth 10 mm and number of punching 480 pcs./cm$^2$. The felt-like sheet thus obtained was subjected to backing, on its reverse surface, with polyurethane 30% dimethylformamide solution ("Crysbon 1825" manufactured by Dainippon Ink Co., Ltd.), and subsequently was solidified in water of 30° C. In the next step, the surface was raised by a hand card for removal of excessive fibers and aligning of implanted fibers. Thereafter, the sample was treated in a 1% solution of silicone series softening agent (Dowcorning DC-108 emulsion) at 50° C. for 15 minutes through gentle liquid flow, and after dehydration and arrangement of the nap or raised hair by a comb, the fabric was dried at 60° C. The static frictional coefficient of the guard hair component was 0.25–0.28 for all cases.

Figure 4:
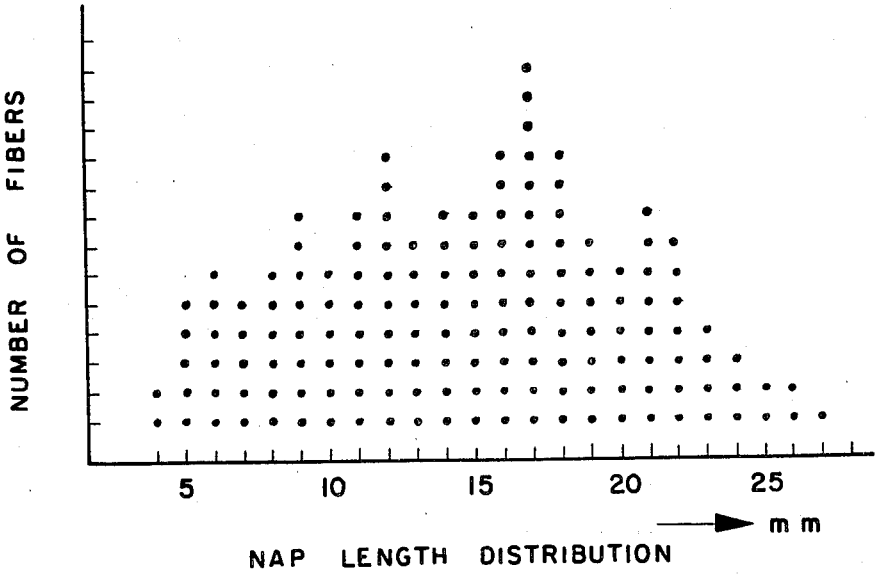
FIG. 4 is a graphical representation showing the distribution of napped fiber lengths and quantity of specific napped fiber lengths taken from a sample made in accordance with Example 1 herein.

152 pieces of raised hair were taken as a random sample, the length distribution thereof is shown in FIG. 4.

In EXAMPLE 1, although no down hair component was contained, the linearity and repellency of the nap, i.e. raised hair were favorable and the fabric exhibited a soft hand.

EXAMPLE 2

In EXAMPLE 2, the resultant fabric had a down hair component of 100%, with a nap density of about 8000 pcs./cm$^2$. It was extremely soft in touch, and had an appearance and hand closely resembling a chinchilla fur.

EXAMPLE 3

In EXAMPLE 3, the fabric obtained was a mink-like fur having a 2 layer structure of guard hair and down hair, and was superior both in appearance and hand.

EXAMPLE 4

Although the resultant fabric was very similar to that of EXAMPLE 3, it was slightly inferior with respect to the hand and self-recovery characteristics of the nap due to absence of the taper effect of the down hair.

EXAMPLE 5

The fabric obtained had very small crimp in the down hair, resulting in a denser feel or hand, but was somewhat inferior to that of EXAMPLE 3 in the aspect of resiliency.

EXAMPLE 6

The fabric obtained had the nap or raised hair length slightly longer than that of mink, and closely resembled that of EXAMPLE 5.

Comparative Data

Although the fiber was of the crimp level normally used in spinning, etc., it had a felt-like structure, and was poor in the raising characteristics, with the felt tending to be peeled off the base cloth. Thus, the nap, i.e. raised hair obtained had much intertwining and was poor in quality.

EXAMPLE 7

Polybutylene terephthalate fibers (40 denier, fiber length 70 mm) sharpened at both ends and containing 0.1 of titanium oxide, were obtained in accordance with the method described in EXAMPLE 1. The fibers were dyed brown by an ordinary method utilizing a disperse dye and a fur-like fabric was produced similar in fashion to the process described in EXAMPLE 1. For the finishing agent, "Ultratex ESB" (silicone series softening agent manufactured by Ciba-Geigy Co.) was imparted to the fabric at a concentration of 1% owf.

The fabric obtained had an average pile length of 52 mm, and a length distribution between a maximum length of 56 mm and a minimum length of 30 mm (when 10 pieces were subjected to random sampling). At one implantation position, 1 to 20 fibers were implanted and these fibers were not inter-connected with other points of implantation, while the points of implantation were arranged to be irregular. On the whole, the fibers were implanted to extend into the base at a density of 900 pcs./cm$^2$. The nap, i.e. raised hair of linear shape, was generally parallel and had almost no intertwining. The end portions of all the naps were substantially in the form of sharpened ends in point form, and had deep tones of shade. This napped fabric was fox fur-like, and showed a soft hand with favorable raised hair resiliency characteristics.

Although this invention has been described in conjunction with certain specific forms and modifications thereof, it will be appreciated that a wide variety of other modifications can be made without departing from the scope and spirit of this invention as defined in the appended claims.

TABLE I

| Raw material | | Cross section | Size (denier) | Fiber length mm | Taper | Crimp | EXAMPLE 1 | 2 | 3 | 4 | 5 | 6 | Comparative Data 1 |
|---|---|---|---|---|---|---|---|---|---|---|---|---|---|
| Guard hair component | Polybutylene terephthalate | Flat cross | 30 | 30 | Both ends | None | 100 | | | | | | |
| | Polybutylene terephthalate | Flat cross | 30 | 40 | Both ends | None | | | 30 | 30 | 30 | | |
| | Polybutylene terephthalate | Round | 40 | 50 | Both ends | None | | | | | | 50 | |
| Down hair component | Polybutylene terephthalate | Round | 5 | 23 | Both ends | None | | 100 | 70 | | | | |
| | Polybutylene terephthalate | Round | 3 | 25 | — | None | | | | 70 | | | |
| | Polybutylene terephthalate | Round | 3 | 25 | — | 5 curls/inch | | | | | 70 | | |
| | Nylon 6 | Round | 5 | 30 | — | 5 curls/inch | | | | | | 50 | |
| | Polybutylene terephthalate | Round | 3 | 25 | — | 15 curls/inch | | | | | | | 100 |

We claim:

1. In a fur-like fabric of the type having a base cloth and a multiplicity of napped fibers extending from said base cloth the improvement wherein:

(a) said napped fibers comprise sharpened tip portions disposed at at least one endwise fiber portion thereof;

(b) said napped fibers being implanted in said base fabric by needle punching and raised from said points of implantation;

(c) said points of implantation are not interconnected by said napped fibers;

(d) said napped fibers are non-uniform in length;

(e) said napped fibers are substantially uncrimped;

(f) said napped fibers are parallel with substantially no intertwining therebetween; and (g) said napped fibers have a static frictional coefficient of less than 0.35.

2. A fur-like fabric as defined in claim 1, wherein said implantation points are irregular in the arrangement thereof.

3. A fur-like fabric as defined in claim 1, further including down hair portions adjacent said base fabric.

4. A fur-like fabric as defined in claim 1, wherein said napped fibers have static frictional coefficients of less than 0.30.

5. A fur-like fabric as defined in claim 1, wherein said napped fibers have bending recovery rates higher than 50%.

6. A fur-like fabric as defined in claim 1, wherein said napped fibers are of the polybutylene terephthalate series.

7. A process for manufacturing a fur-like fabric mainly covered with nap, which comprises the steps of:

forming fiber layer comprised of short, substantially uncrimped fibers having tapered tip portions on a base fabric, implanting said fibers into said base fabric by needle punching, such that said implantation points are irregular in arrangement, raising said fibers from said implantation points to produce a raised fiber surface wherein the portions between the implantation points are not interconnected by the raised fibers, the raised fibers are non-uniform in length and the raised fibers are parallel with substantially no intertwining therebetween; and reducing the static frictional coefficient of the fibers constituting the raised nap to less than 0.35 with a finishing agent.

8. A process for manufactureing a fur-like fabric as defined in claim 7, further including the step of substantially removing those fibers not implanted into the base cloth.

9. A process for manufacturing a fur-like fabric as defined in claim 7, further including the step of backing the base fabric at the reverse surface before the raising step.

* * * * *

UNITED STATES PATENT AND TRADEMARK OFFICE

CERTIFICATE OF CORRECTION

PATENT NO. : 4,418,104

DATED : 11/29/83

INVENTOR(S) : Yoshiteru Kiyomura; Yutaka Masuda; Tatsuji Kojima

It is certified that error appears in the above-identified patent and that said Letters Patent is hereby corrected as shown below:

Column 4, line 12, delete "(1-ℓ)" and substitute --(L-1)--.

Column 4, line 13, delete "(ℓ)" and substitute --(1)--.

Signed and Sealed this

*Eighth* Day of *May 1984*

[SEAL]

*Attest:*

GERALD J. MOSSINGHOFF

*Attesting Officer*

*Commissioner of Patents and Trademarks*